US008534996B1

(12) United States Patent
Pankey et al.

(10) Patent No.: US 8,534,996 B1
(45) Date of Patent: Sep. 17, 2013

(54) VANE SEGMENT TIP CLEARANCE CONTROL

(75) Inventors: William W. Pankey, Palm Beach Gardens, FL (US); Jack W. Wilson, Jr., Palm Beach Gardens, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 1038 days.

(21) Appl. No.: 12/558,705

(22) Filed: Sep. 14, 2009

Related U.S. Application Data

(60) Provisional application No. 61/096,942, filed on Sep. 15, 2008.

(51) Int. Cl.
*F01D 11/22* (2006.01)

(52) U.S. Cl.
USPC ..... 415/173.2; 415/174.1; 415/127

(58) Field of Classification Search
USPC ..... 415/134, 136, 138, 139, 173.1, 173.2, 415/174.1, 126, 127
See application file for complete search history.

(56) References Cited

U.S. PATENT DOCUMENTS

| | | | | |
|---|---|---|---|---|
| 4,714,404 | A * | 12/1987 | Lardellier | 415/127 |
| 5,054,997 | A * | 10/1991 | Corsmeier et al. | 415/173.2 |
| 5,104,287 | A * | 4/1992 | Ciokajlo | 415/173.2 |
| 2007/0003411 | A1 * | 1/2007 | Manzoori | 415/173.2 |

* cited by examiner

*Primary Examiner* — Edward Look
*Assistant Examiner* — William Grigos
(74) *Attorney, Agent, or Firm* — John Ryznic

(57) ABSTRACT

A compressor stator vane and rotor blade tip clearance control assembly in which a plurality of stator vane segments each with vanes extending inward are connected to an annular sync ring through eccentric cranks so that circumferential movement of the sync ring will produce radial displacement of the vane segments and control the clearance between the blade tips. An actuator piston is rigidly fixed to the sync ring and forms an actuator chamber with stationary actuator housing. Bleed off pressure from one of the compressor stages is used to move the actuator piston, which moves the sync ring to radially displace the vane segments.

10 Claims, 6 Drawing Sheets

VANE SEGMENT TIP CLEARANCE CONTROL

FEDERAL RESEARCH STATEMENT

None.

CROSS-REFERENCE TO RELATED APPLICATIONS

This application claims the benefit to an earlier filed U.S. Provisional Application 61/096,942 filed on Sep. 15, 2008.

BACKGROUND OF THE INVENTION

1. Field of the Invention

The present invention relates generally to gas turbine engines, and more specifically to a compressor with tip clearance control between vane segments and rotor blade tips.

2. Description of the Related Art Including Information Disclosed Under 37 CFR 1.97 and 1.98

A multiple stage compressor, such as that used in a gas turbine engine, includes several rows or stages of rotor blades positioned between the same number of rows or stator vanes. A row of stator vanes is positioned directly in front of a row of rotor blades and function to guide the air flow into the rotor blades at a most optimal angle for higher performance. Because there is relative rotation between the blade and the vane structures, a gap is formed in which the fluid passing through the compressor can leak around the blades. If this gap or clearance is too large, the efficiency of the compressor will be affected. The gaps are formed between the rotor blade tips and an outer shroud surface, and between the rotor blade platforms or root section and the stator blade inner shroud assembly.

The gap or clearance between the stator and the rotor sections can change during operation of the compressor. Also, thermal loads can also cause the gaps to change due to material growth. Thus, to provide improved performance of the compressor, systems that regulate the gap spacing are used.

BRIEF SUMMARY OF THE INVENTION

It is an object of the present invention to provide for an axial flow compressor with blade tip clearance control.

An annular arrangement of stator vane segments, each with a plurality of stator vanes extending inward, is connected to an annular sync ring through a pair of eccentric cranks. A piston fixed to the sync ring is moved by application of fluid pressure to one of two piston chambers. Movement of the sync ring produces a radial displacement of the stator vane segments to control the blade tip clearance.

One or more rectangular actuators are connected to the sync ring to move the sync ring in a circumferential direction. An integral actuator is formed within an outer casing section with the sync ring positioned on the inside of the outer casing. The integral actuator piston is rigidly attached to the sync ring by bolts, and with the sync ring carries a compliant seal within a seal groove to provide a seal for the rectangular pressure chambers and the rectangular piston that moves within the chamber.

DETAILED DESCRIPTION OF THE INVENTION

Figure 1:
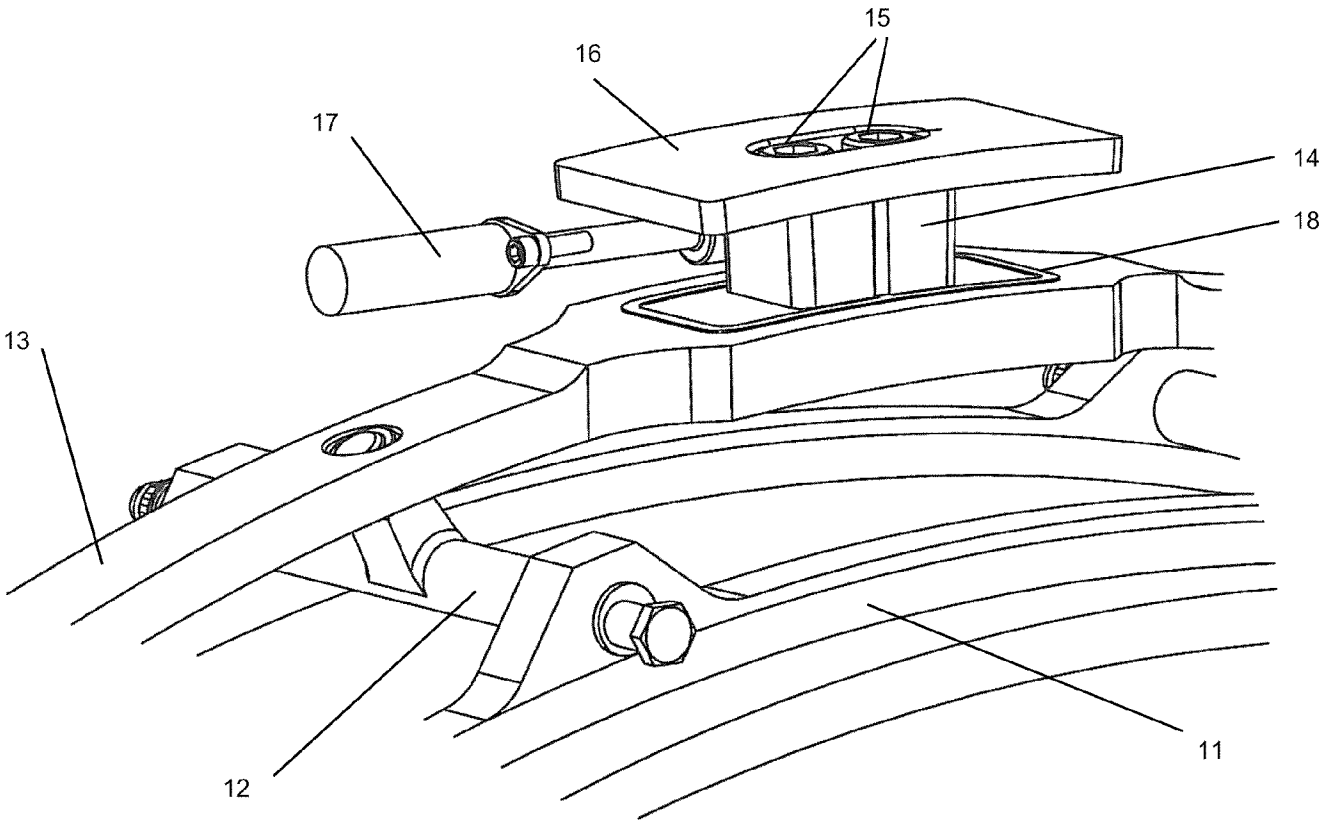
FIG. 1 shows a schematic view of the integral piston secured to the sync ring, and the eccentric cranks connecting the sync ring to the stator vane segments.

FIG. 1 shows a section of the sync ring and stator vane segments with the eccentric crank connection between them. The sync ring 13 is a full 360 annular ring that can be formed from several segments rigidly connected together is order to assemble it in place within the compressor. One or more rectangular pistons 14 are rigidly fixed to the sync ring 13 each by two bolts 15. A top housing 16 of the rectangular actuator housing is connected by the two bolts 15 to the rectangular piston 14. a control valve 17 is shown in relation to the rectangular actuator piston 14. A plurality of stator vane segments 11 is located radial inward from the sync ring 13 as seen in FIG. 1. A plurality of stator vanes extends from an inner surface of each vane segment and forms a gap with a surface on the rotor of the compressor. The inner surface of the vane segment forms a gap with the blade tips of the compressor. Each vane segment 11 is connected to the sync ring 13 by two eccentric cranks 12. The eccentric cranks 12 include an axial member that rotates within a hole in an outer extension of the vane segment 11 and a radial member that pivots within a hole of the sync ring 13. The eccentric crank is offset in the axial hole of the vane segment outer extension so that rotation of the crank displaces the vane segment in a radial direction. Circumferential movement of the sync ring 13 will pivot the eccentric crank 12 and produce this radial displacement.

One or more rectangular actuators are connected to the sync ring 13 to move the sync ring 13 in a circumferential direction. An integral actuator 14 is formed within an outer casing section with the sync ring 13 positioned on the inside of the outer casing. The integral actuator piston is rigidly attached to the sync ring 13 by bolts 15, and with the sync ring 13 carries a compliant seal 18 within a seal groove to provide a seal for the rectangular pressure chambers and the rectangular piston that moves within the chamber.

Figure 2:
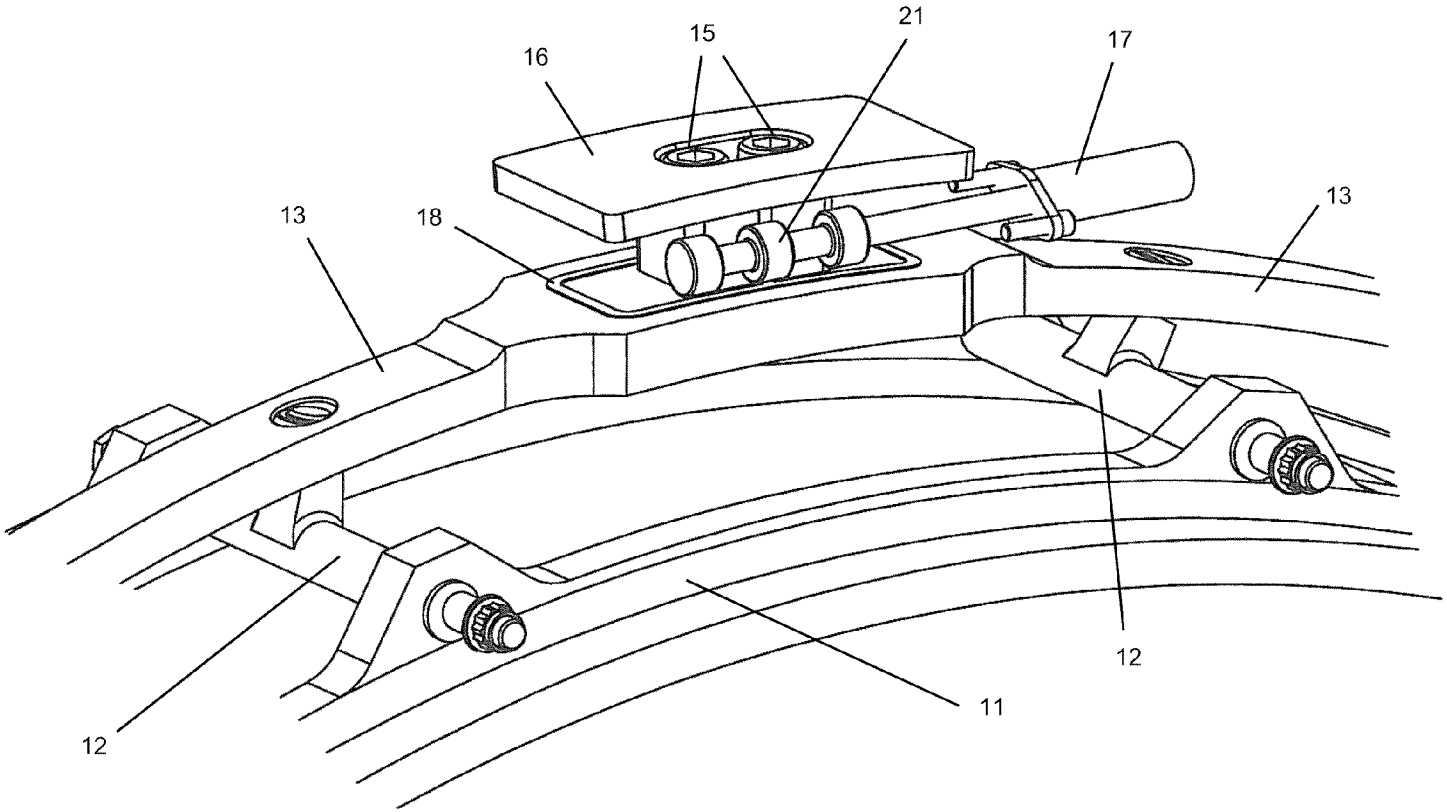
FIG. 2 shows a schematic view of the control valve arrangement with respect to the rectangular pressure chamber and piston assembly.

FIG. 2 shows a schematic view of the sync ring and vane segment assembly from an opposite side that FIG. 1 show. the sync ring 13 and eccentric crank 12 connection to the vane segments 11 is shown with the control valve 17 and its valve spool 21 shown on this side of the actuator piston. Axial movement of the spool valve will apply pressure to one of the two rectangular actuator chambers to move the rectangular piston to one of two sides of the actuator. As seen in FIGS. 1 and 2, the sync ring 13 and the rectangular piston 14 and the outer actuator housing 16 form one rigid integral piece that moves together as one unit.

Figure 3:
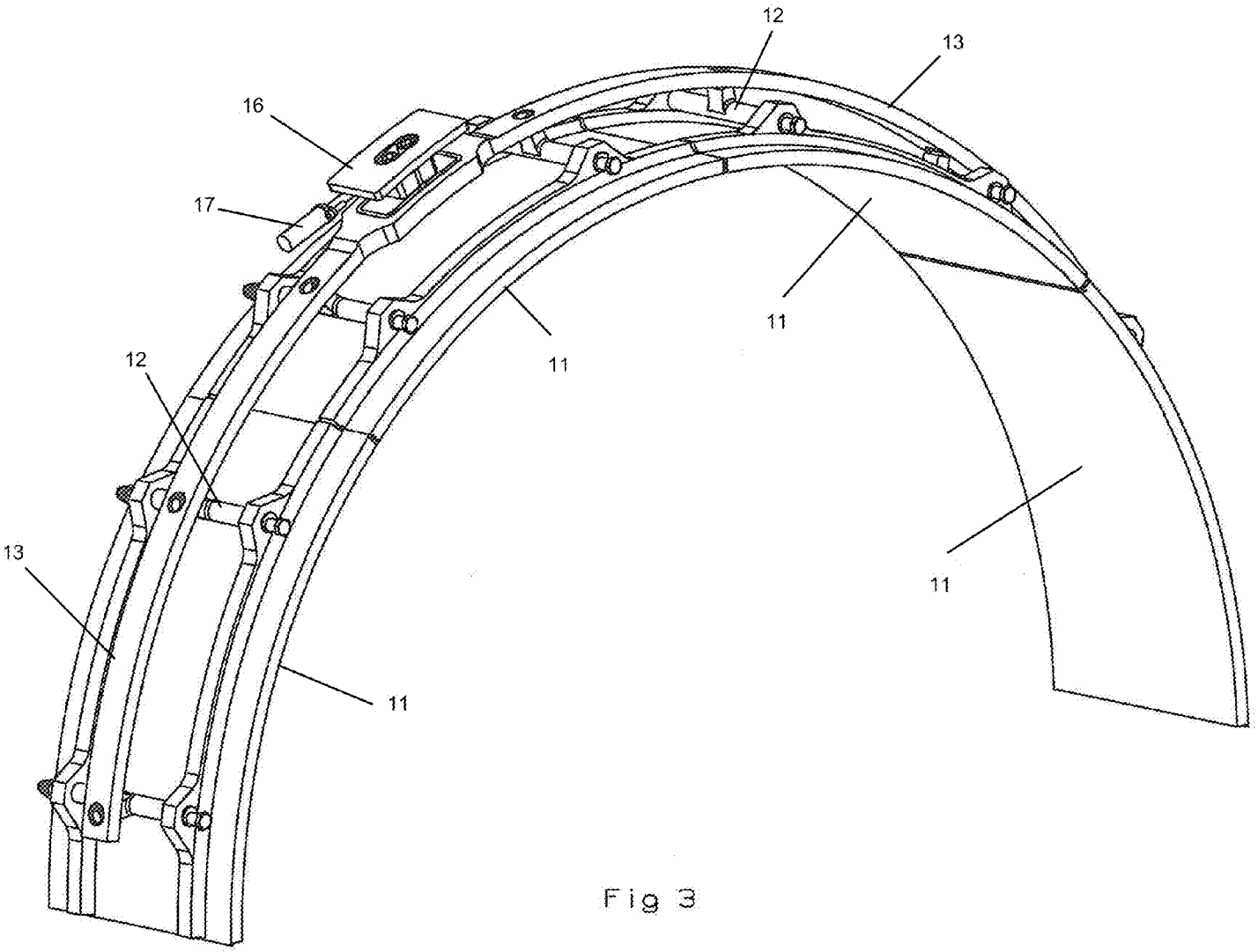
FIG. 3 shows a schematic view of a 180 degree segment of the sync ring and stator vane segments with the eccentric cranks and rectangular piston.

FIG. 3 shows a 180 degree segment of the stator vane segments with four vane segments 11 each connected by two eccentric cranks 12 to the sync ring 13. The actuator outer housing 16 and the control valve 17 are shown in relation to the sync ring 13. More than one actuator is used to move the sync ring 13 because the sync ring 13 is a full 360 degree annular ring and to more evenly apply the force to move the sync ring 13.

Figure 4:
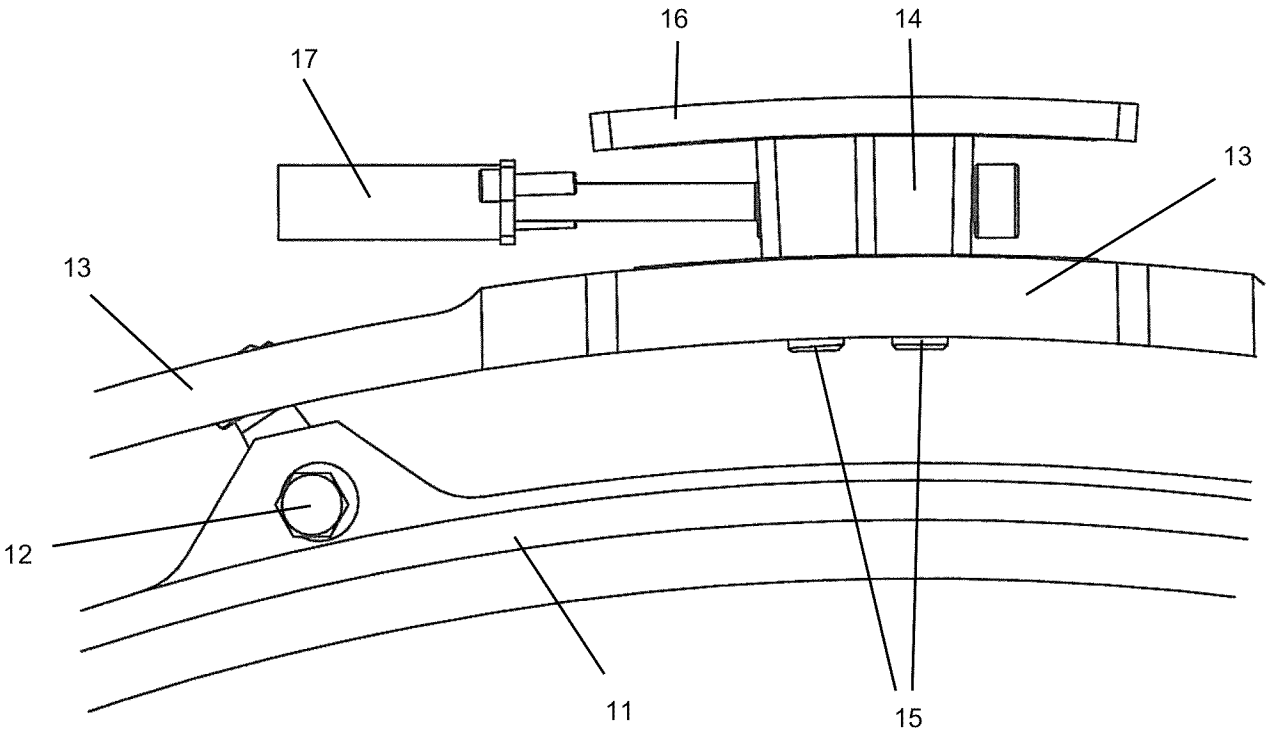
FIG. 4 shows a side view of the rectangular piston connected to the sync ring with the control valve spool positioned in the valve chamber.

FIG. 4 shows a cross section view through a cut of the actuator and the connection to the sync ring 13. The rectangular piston 14 and the outer actuator housing 16 are secured to the sync ring 13 with the two bolts 15. The control valve 17 is shown in its relative position extending along one side of the actuator housing. Circumferential movement of the sync ring 13 will pivot the eccentric crank 12 and cause the vane segment 11 to be displaced in the radial direction.

Figure 5:
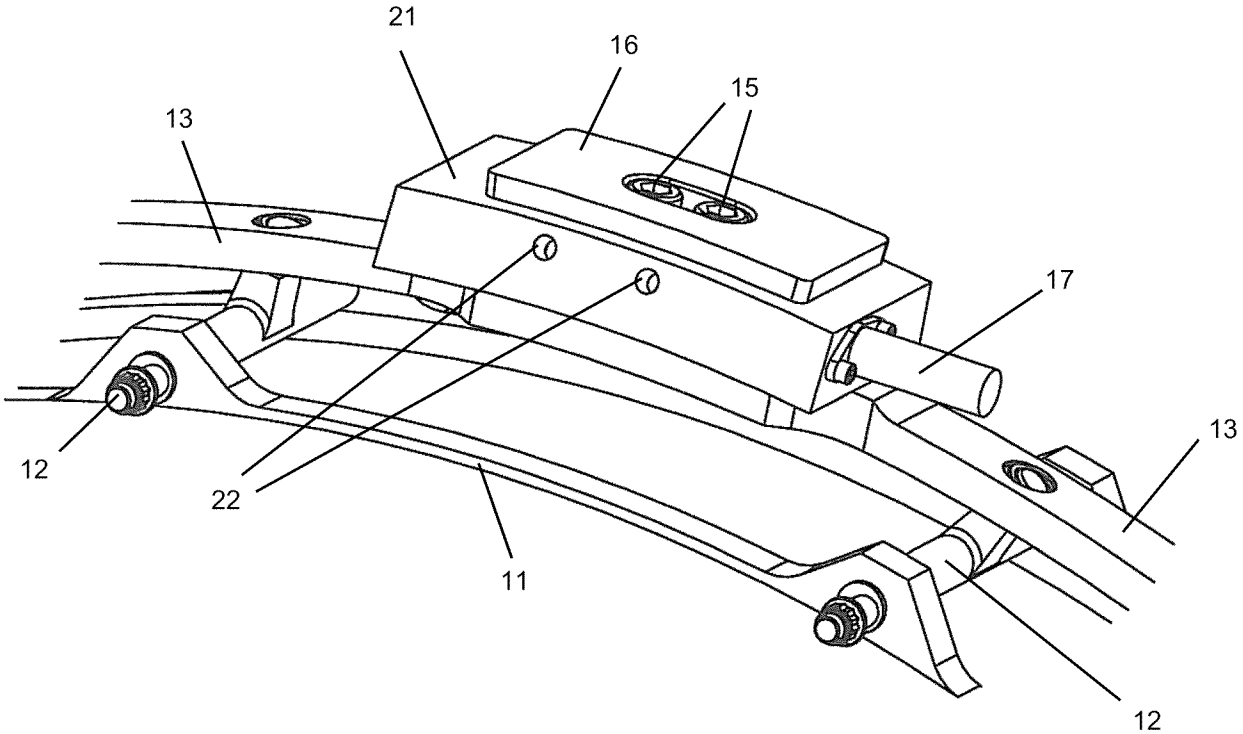
FIG. 5 shows the rectangular actuator housing positioned over the sync ring that is connected to the stator vane segment through the eccentric cranks, and the valve spool extending into the control valve housing.

FIG. 5 shows the rectangular actuator with the actuator housing 21 that is secured to an engine casing so that the actuator housing 21 does not move. The rectangular piston and the outer actuator housing 15 are shown with the two bolts 15 that connect the outer actuator housing to the rectangular piston. The outer actuator housing 16 moves circumferentially with the sync ring 13 and form an outer enclosure for the two actuator pressure chambers on the sides of the rectangular actuator piston 14. The actuator housing 21 includes two ports 22 for the supply and exhaust of the fluid used to drive the actuator piston 14. The spools on the control valve 17 regulate the fluid pressure from the source through the two ports 22. In the preferred embodiment, the pressure source to drive the actuator is bleed off air from one or more stages of the compressor. One stage is at a higher pressure than another stage, and thus the pressure source can be regulated by choosing which stage to bleed off the compressed air from. The sync ring 13 will form a bottom wall of the actuator pressure chamber while the outer actuator housing 16 will form the top wall. The actuator housing 21 that does not move will form the two side walls and the two end walls of the chambers. The rectangular piston 14 will move in the circumferential direction towards one of the two end walls of the stationary actuator housing 21.

Figure 6:
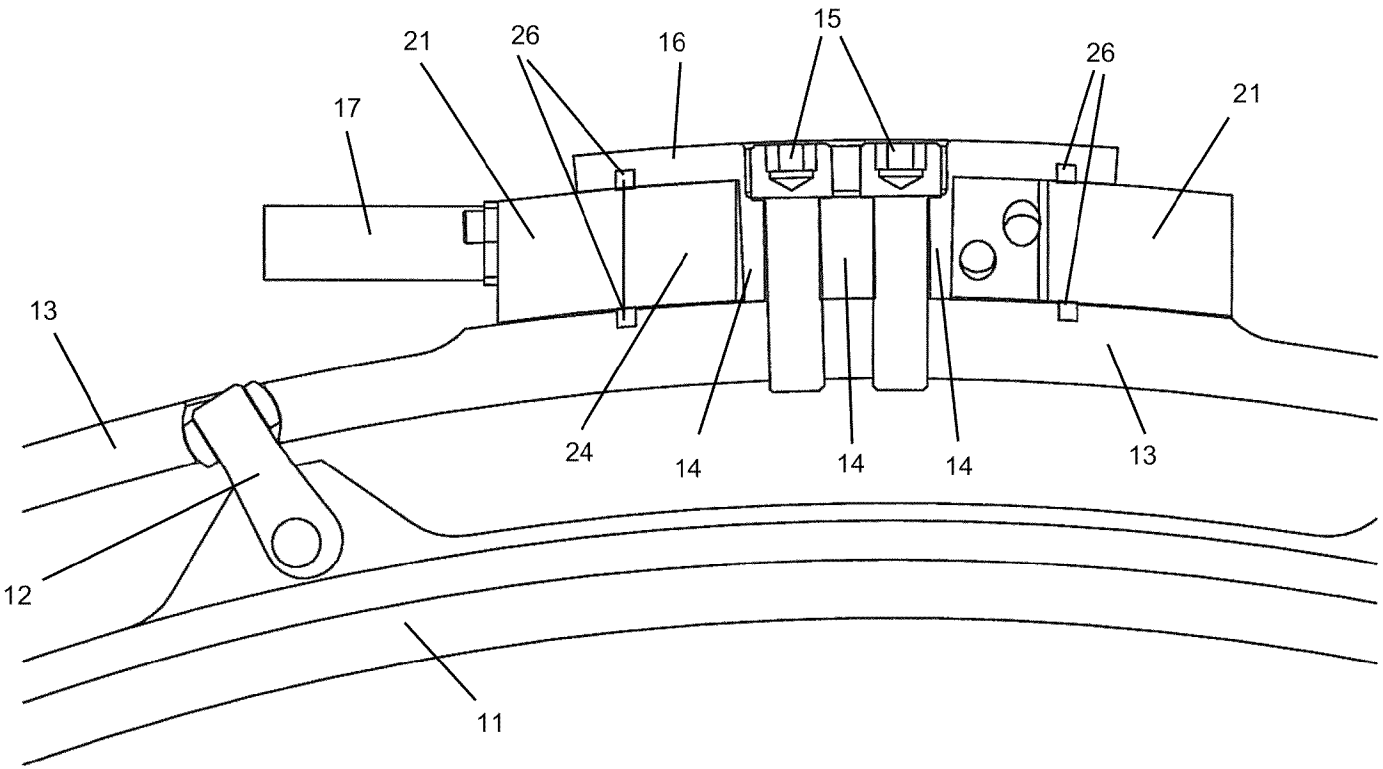
FIG. 6 shows a cross section view of the rectangular actuator with the piston secured to the sync ring, and the two pressure chambers formed between the piston and the actuator housing.

FIG. 6 shows a cross section view of the actuator connected to the sync ring 13. The piston 14 is connected to the sync ring 13 with the two bolts 15. The piston defines a pressure chamber 24 with the actuator housing 21. Seals 26 provide for a fluid seal between the sync ring 13 and the actuator housing 21. The actuator housing 21 is fixed to the engine casing and therefore does not move. The rectangular piston 14 is moved circumferentially by application of the bleed off air from one stage of the compressor. Movement of the actuator 14 moves the sync ring 13, which then moves the vane segments 11 through the pivoting motion of the eccentric cranks 12.

The motive fluid used to drive the actuation piston 14 can be the pressure differential between the compressor supply pressure of one of its stages and atmospheric pressure. In this case, the compressor stage pressure is directly connected to one piston actuation chamber 24 and the atmospheric pressure connected to the opposite chamber to produce a differential pressure about equal to the pressure supplied from the stage of the compressor. This is only a differential pressure and not a flow of compressed air from that stage that is used to drive the actuator piston 14, so not much compressed air is wasted in the pneumatic control of the sync ring. The differential pressure required for movement of a certain actuation piston 14 would be met by tapping into the compressor stage that can supply that amount of pressure related to the atmospheric pressure.

In a gas turbine engine, the compressor has many stages of rotor blades and stator vanes. Each stage or row of stator vanes can be connected to a segmented vane assembly that is radially displaced by the eccentric crank and sync ring assembly of the present invention. The vane tip and rotor blade tip spacing can be controlled by the circumferential movement of the sync ring 13. Each stage of vanes and blades can be independently controlled by its own separate sync ring and eccentric crank assembly of the present invention.

We claim the following:

1. A compressor blade tip clearance control assembly comprising:

a stator vane segment with an inner surface having a plurality of stator vanes extending inward;

an annular sync ring positioned radial outward of the stator vane segment and fixed to a compressor casing so allow only circumferential movement;

an eccentric crank fixed to the stator vane segment on one end and to the sync ring on an opposite end such that circumferential movement of the sync ring produces a radial movement of the stator vane segment;

an actuator piston rigidly fixed to the sync ring;

an actuator housing forming two pressure chambers with the actuator piston, the actuator housing being stationary to the compressor casing; and, a control valve associated with the actuator housing to regulate a fluid pressure in the actuator pressure chambers to move the actuator piston in a circumferential direction.

2. The compressor blade tip clearance control assembly of claim 1, and further comprising:

an outer actuator housing secured to an outer surface of the actuator piston; and, the sync ring and the outer actuator housing defining top and bottom walls of the actuator pressure chambers.

3. The compressor blade tip clearance control assembly of claim 1, and further comprising:

the eccentric crank includes an axial inner piece and a radial outer piece;

the top end of the radial piece pivoting within a hole formed in the sync ring; and, the axial piece having an offset eccentric that rotates within a hole of the stator vane segment.

4. The compressor blade tip clearance control assembly of claim 1, and further comprising:

the sync ring is a full 360 degree ring formed around the stator vanes; and, each stator vane segment is connected to the sync ring through two eccentric cranks.

5. The compressor blade tip clearance control assembly of claim 1, and further comprising:

a plurality of actuator pistons connected to the sync ring, where the actuator pistons are circumferentially spaced around the sync ring at about the same spacing to more evenly apply a force to the sync ring from the actuator pistons.

6. The compressor blade tip clearance control assembly of claim 1, and further comprising:

the stator vane segments form a blade tip gap with the inner surface of the vane segments.

7. The compressor blade tip clearance control assembly of claim 1, and further comprising:

the actuator piston is a rectangular piston.

8. The compressor blade tip clearance control assembly of claim 1, and further comprising:

a pressure source for the actuator piston is one of the stages of the compressor.

9. The compressor blade tip clearance control assembly of claim 8, and further comprising:

a low pressure source of an opposite chamber of the actuator piston from the pressurized source is atmospheric pressure.

10. The compressor blade tip clearance control assembly of claim 4, and further comprising:

eight stator vane segments are connected to the one sync ring.

* * * * *